US007463152B2

(12) United States Patent
Marsilio et al.

(10) Patent No.: US 7,463,152 B2
(45) **Date of Patent: *Dec. 9, 2008**

(54) BOTTLE SECURITY DEVICE

(75) Inventors: Ronald M. Marsilio, Lake Wiley, SC (US); Christopher J. Fawcett, Charlotte, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/810,648

(22) Filed: Jun. 6, 2007

(65) Prior Publication Data

US 2007/0273536 A1 Nov. 29, 2007

Related U.S. Application Data

(63) Continuation of application No. 11/022,084, filed on Dec. 22, 2004, now Pat. No. 7,259,674.

(51) Int. Cl.
*G08B 13/14* (2006.01)

(52) U.S. Cl. ..... 340/572.1; 340/571; 340/572.8; 340/572.9; 24/704.1; 70/57.1; 215/201; 215/212; 215/279; 292/256; 292/325; D10/104

(58) Field of Classification Search ..... 340/572.1, 340/571, 572.8, 572.9, 542, 551; 24/704.1, 24/456; 70/57.1; 215/201, 212, 279; 292/256, 292/325

See application file for complete search history.

(56) References Cited

U.S. PATENT DOCUMENTS

| | | | |
|---|---|---|---|
| 2,125,052 | A | 7/1938 | Ranson |
| 3,214,808 | A | 11/1965 | Litwin |
| 3,712,655 | A | 1/1973 | Fuehrer |
| 3,874,034 | A | 4/1975 | Clayton |
| 4,023,157 | A | 5/1977 | Miller |
| 4,059,299 | A | 11/1977 | Huntley |
| 4,128,220 | A | 12/1978 | McNeel |
| 4,196,424 | A | 4/1980 | Williamson |
| 4,287,644 | A | 9/1981 | Durand |
| 4,502,305 | A | 3/1985 | Bakker |
| 4,506,415 | A | 3/1985 | Swift |
| 4,580,319 | A | 4/1986 | Paradis |
| 4,708,306 | A | 11/1987 | Mitomi |
| 4,929,006 | A | 5/1990 | Tsay |
| 4,958,411 | A | 9/1990 | Stanley |
| 5,079,540 | A | 1/1992 | Narlow et al. |
| 5,123,686 | A | 6/1992 | Wenk |
| 5,193,254 | A | 3/1993 | Geisinger |
| 5,230,541 | A | 7/1993 | Nowak |
| 5,337,503 | A | 8/1994 | Goby |

(Continued)

*Primary Examiner*—Davetta W. Goins
(74) *Attorney, Agent, or Firm*—Sand & Sebolt

(57) ABSTRACT

A security device for securing around a generally cylindrical article such as the neck of a bottle includes a housing which forms a lock compartment and which contains an EAS security device and a magnetically actuated lock mechanism. A ratchet strap have a series of locking teeth and is formed integrally with the housing and extends outwardly therefrom and has sufficient rigidity to assume a generally circular configuration with a curved article contact surface of the housing to facilitate attaching the device around the article. The lock mechanism includes a locking pawl which engages the strap teeth and an actuation strip which biases the pawl toward locking engagement with the strap.

20 Claims, 8 Drawing Sheets

U.S. PATENT DOCUMENTS

| | | | |
|---|---|---|---|
| 5,377,510 | A | 1/1995 | Smith |
| 5,398,383 | A | 3/1995 | Bingold |
| 5,413,393 | A | 5/1995 | Georgopoulos et al. |
| 5,437,172 | A | 8/1995 | Lamy et al. |
| 5,524,463 | A | 6/1996 | Schenkel et al. |
| 5,568,951 | A | 10/1996 | Morgan |
| 5,602,530 | A | 2/1997 | Holmgren |
| 5,791,079 | A | 8/1998 | Mazzucchelli |
| 5,794,461 | A | 8/1998 | Smith |
| 5,883,576 | A | 3/1999 | De La Huerga |
| 5,957,313 | A | 9/1999 | Bouan |
| 5,969,613 | A | 10/1999 | Yeager et al. |
| 6,044,669 | A | 4/2000 | Levi |
| 6,098,256 | A | 8/2000 | Poussard |
| 6,188,320 | B1 | 2/2001 | Kolton et al. |
| 6,226,839 | B1 | 5/2001 | Savegh |
| 6,311,531 | B1 | 11/2001 | Sykes |
| 6,326,890 | B1 | 12/2001 | Costa |
| 6,422,387 | B1 | 7/2002 | Sedon et al. |
| 6,523,228 | B1 | 2/2003 | Benoit |
| 6,532,631 | B2 | 3/2003 | Rohaly et al. |
| 6,631,629 | B1 | 10/2003 | Fuss et al. |
| 6,666,330 | B2 | 12/2003 | Sedon et al. |
| 6,676,175 | B2 | 1/2004 | Jaeb et al. |
| 6,755,055 | B2 | 6/2004 | Sedon et al. |
| 6,822,567 | B2 | 11/2004 | Durbin |
| 7,032,415 | B2 | 4/2006 | Young |
| 2005/0062608 | A1* | 3/2005 | Costa ..... 340/572.9 |
| 2005/0211658 | A1 | 9/2005 | Bagration De Ulloa |
| 2006/0048551 | A1 | 3/2006 | Tanos |

* cited by examiner

BOTTLE SECURITY DEVICE

CROSS REFERENCE TO RELATED APPLICATION

This application is a continuation of U.S. patent application Ser. No. 11/022,084, filed Dec. 22, 2004; the disclosure of which is incorporated herein by reference.

BACKGROUND OF THE INVENTION

1. Technical Field

The invention relates to anti-shoplifting devices, and more particularly to an anti-shoplifting device for merchandise having a cylindrical surface and in particular, for bottles having a cylindrical neck. The invention provides a security device that holds an electronic article surveillance tag (EAS tag) which is concealed within a rigid housing which is secured by a ratchet strap around the neck of the bottle. The security device contains a magnetic actuated lock, which when in locked position prevents removal of the security device from the bottle or other article of merchandise.

2. Background Information

Shoplifting from retail establishments has become an increasing problem in recent times. In response to the shoplifting problem, many types of anti-shoplifting devices have been developed for protecting different types of merchandise. Many of these devices include tags that are attached to the items of merchandise in a manner where they cannot be easily removed from the merchandise and which will sound an alarm when removed from the store. It is preferred that these EAS tags be hidden within the items such that a shoplifter cannot remove the tag without breaking a portion of the merchandise or the container in which it is installed. Many of these security devices are used to protect recorded media such as CDs, DVDs, VHS cassettes, etc. which are stored within rectangular parallelopiped boxes, many of which contain either a mechanical locking device locked by a mechanical key or a magnetically operated locking device or a combination thereof. Some examples of the magnetically operated locking devices are shown in U.S. Pat. Nos. 6,422,387, 6,666,330, 6,676,175, and 6,755,055.

Although these devices have proved satisfactory for such articles, they are not adaptable for articles such as bottles which are usually formed of glass and have a neck and closure cap thereon. Some of these bottles contain expensive products such as wine and liquor, which in some locations are stored on a shelf and not behind a counter, thus becoming susceptible to shoplifting. It is a desire to protect these bottles by attaching a security device easily around the neck of the bottle which contains an EAS tag, which devices can be reused to reduce cost to the retail establishment, and which devices can be placed easily and rapidly on the neck of the bottle for display without occupying an appreciable amount of storage and display space. These devices also must be able to be mass produced relatively inexpensive to enable the retail establishment to purchase a number of the devices for use on their displayed products.

Various types of devices have been developed which use a ratchet-type strap which is secured around an object, preventing removal of the strap to protect various items. Many of these devices use a flat plastic strap, either attached to or formed as part of the latching mechanisms, which for many applications do not have any lock and do not contain an EAS tag. Examples of such ratchet-type straps are shown in U.S. Pat. Nos. 3,214,808, 4,128,220, 4,287,644, 4,506,415, 4,580,319, 4,958,411, and 5,123,686.

Other types of devices using a ratchet strap which is desired since it provides an infinite number of latching positions on an item to be protected, has an EAS tag and some type of mechanical key operated locking mechanism. Examples of such prior art security devices are shown in U.S. Pat. Nos. 5,437,172, 5,524,463, 5,969,613, 6,311,531, 6,326,890, and 6,044,669. Some of these devices have also been used for protecting bottles which includes an EAS tag and a mechanical locking device such as shown in U.S. Pat. No. 6,098,256.

Although many of these devices perform satisfactory for their intended purpose, many of them are relatively expensive to manufacture due to the number of separate components that must be assembled. Also, many of these devices are relatively difficult to install and remove from the article of merchandise due to the particular type of latching or locking mechanism and mechanical actuated key for unlocking the security device and removing it from the article being protected.

Therefore, the need exists for an improved security device preferably for use on cylindrical-shaped objects, such as bottles, which device contains an EAS tag in a concealed housing which will actuate an alarm if removed from the store without first removing the security device from the purchased article, and which can be unlocked easily by a magnetic key to avoid the use of mechanical actuated locks which are usually more difficult to operate and require numerous components for incorporating the same in a protected housing.

BRIEF SUMMARY OF THE INVENTION

The present invention provides a security device that is attached to an article of merchandise, preferably one having a generally cylindrical surface such as the neck of a bottle, without appreciably increasing the size of the protected article and reduction in display storage case.

Another aspect of the invention is to provide a security device which can be mass produced relatively inexpensive of plastic components, in which a ratchet strap is formed integrally with the housing and is formed of a sufficiently rigid plastic material whereby the strap has a preset curvature thereto so that the distal end thereof is located closely adjacent the entry port of the lock housing to facilitate the placement of the security device around the neck of the bottle and subsequent attachment to the bottle in a secured locked position. This enables a number of the security devices to be placed on a number of articles being protected in a relatively simple and time efficient manner.

A still further aspect of the invention is to provide a security device in which the lock can be actuated only by a certain type of magnetic key which must be accurately placed on the device in order to actuate a two-piece magnetic sensitive locking mechanism secured within the protective housing.

Another aspect of the invention is to provide such a security device which is provided with a plurality of pain bumps on the housing, that is, small, thin projections which retard a possible shoplifter from grasping the housing and applying sufficient pressure thereto when attempting to twist the housing and strap from the neck of the protected bottle.

A further aspect of the invention is to provide the housing with a curved arcuate flange which forms a portion of the housing and extends outwardly beyond the sidewalls of the housing to provide a relatively large article contacting surface which prevents excess twisting force from being applied to the housing when attempting to twist the security device from the neck of the bottle, and in which the flange forms an inner surface of the housing to provide a guide path for the preset curvature of the ratchet strap.

These features are obtained by the improved security device of the present invention, the general nature of which may be stated as including a rigid housing having a lock compartment with an entry port and a ratchet strap formed integrally with the housing and extending outwardly therefrom, said strap having a series of one-way locking teeth formed thereon and has sufficient stiffness to provide a preset curvature to the strap whereby the strap assumes a generally circular configuration with a portion of the housing to facilitate attaching the device around the article; an EAS tag disposed within the housing; and a locking mechanism disposed within the lock compartment, said locking mechanism including a magnetically attractable locking pawl biased toward locking engagement with one of the locking teeth for securing the strap in a locked position.

BRIEF DESCRIPTION OF THE SEVERAL VIEWS OF THE DRAWINGS

A preferred embodiment of the invention illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
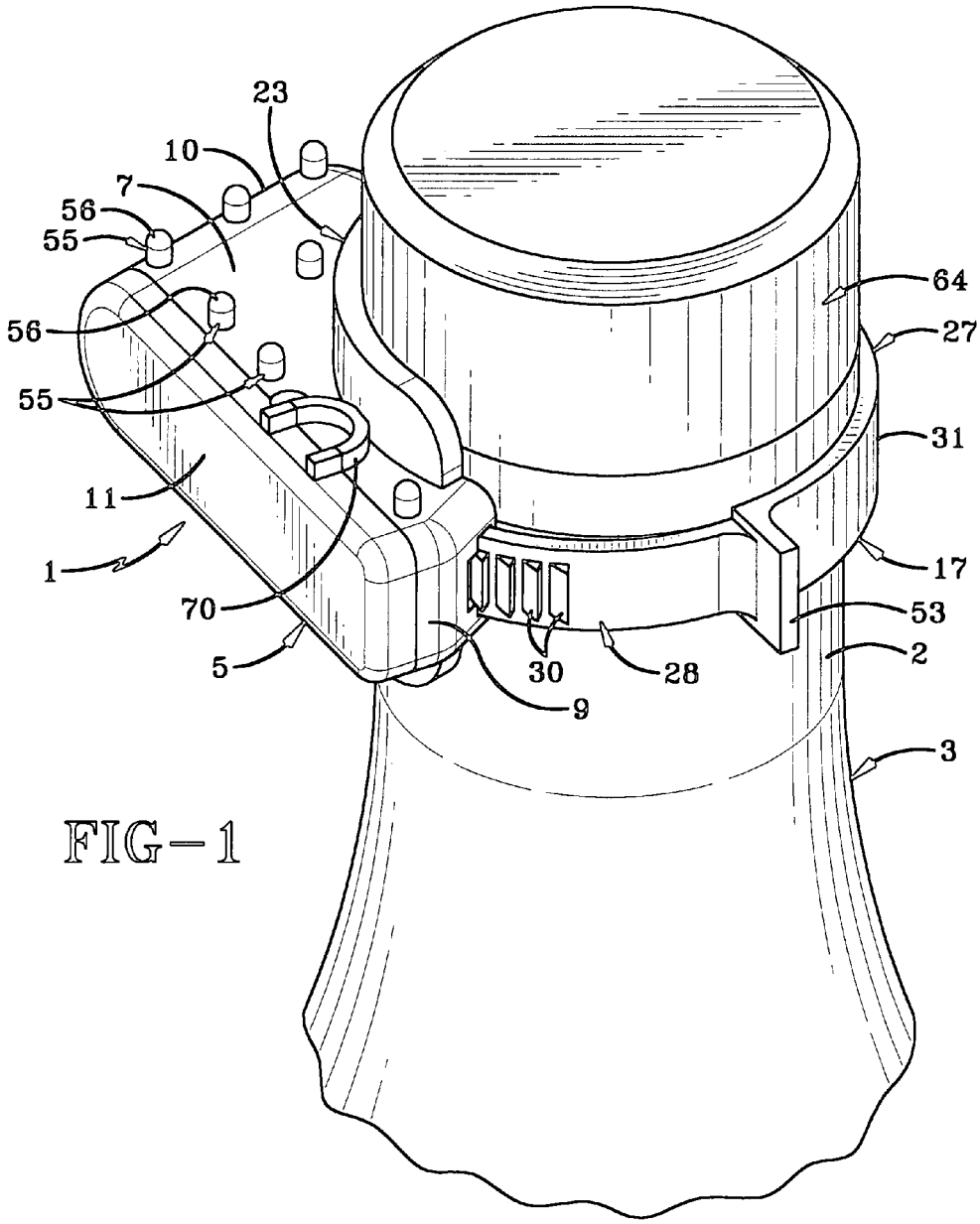
FIG. 1 is a perspective view of the improved security device in a closed locked position around the neck of a bottle being protected thereby.

The security device of the present invention is indicated generally at 1, and is shown in a locked condition about the neck 2 of a bottle 3. Security device 1 includes a lock housing indicated generally at 5 (FIG. 2), which is formed of a rigid plastic and which includes a pair of spaced side walls 7, front and rear end walls 9 and 10, and a closure wall 11. These walls form an interior lock chamber 13 (FIG. 3) in which is stored an electronic security device 15. Device 15 can be of various configurations and types and is referred to broadly in the security industry as an EAS tag, and is usually magnetically or radio wave activated in order to sound an alarm while passing through a gate, usually located at the exit of the store, unless deactivated or removed from the bottle 3 at the time of purchase.

Figure 2:
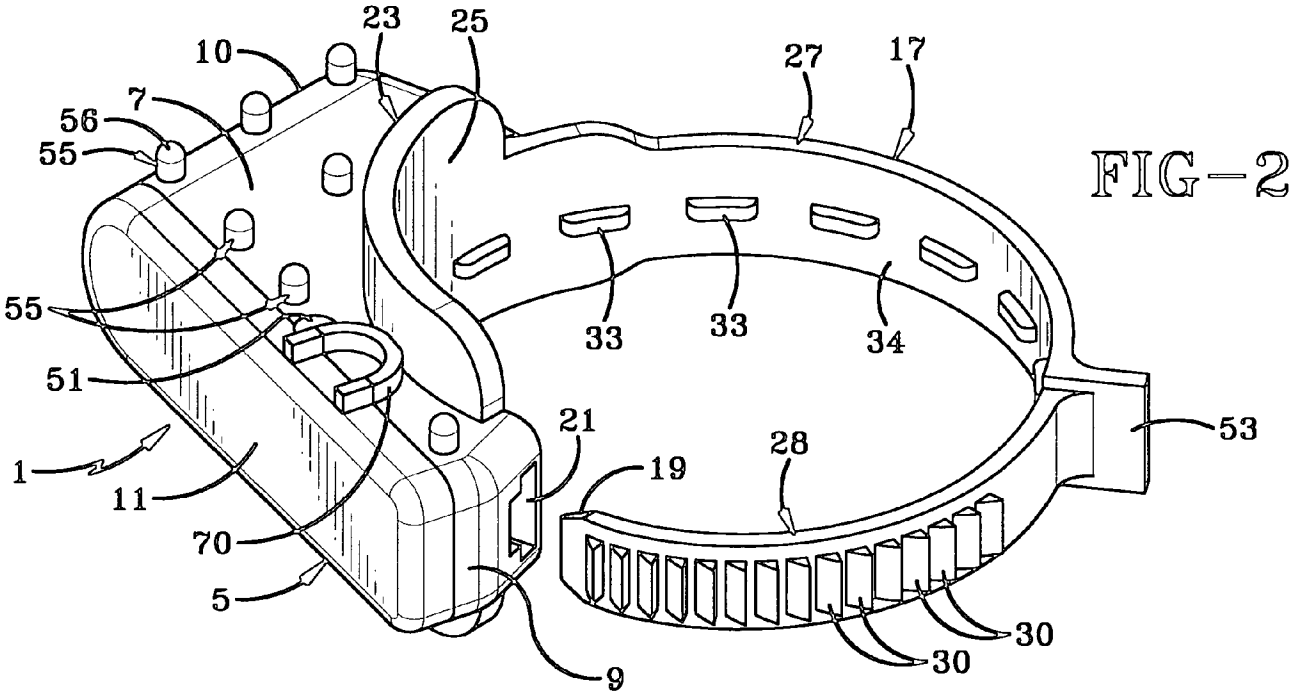
FIG. 2 is a perspective view of the security device of FIG. 1 removed from the bottle in an unlocked position.

In accordance with one of the features of the invention as shown particularly in FIG. 2, a ratchet strap indicated generally at 17, is formed integrally with housing 5 and extends outwardly therefrom terminating in a distal end 19. Strap 17 is formed of a sufficient rigid material, preferably the same plastic material as that of housing 5, in order to have a preset curvature thereto whereby distal end 19 is located closely an adjacent inlet port 21 formed in end wall 9 of housing 5, prior to being installed on a bottle. The curvature of strap 17 together with a curved inner surface of housing 5 forms a generally circular configuration. This configuration greatly facilitates the placement of security device 1 around an object such as neck 2 of bottle 3, since it can be slid directly over the top of the bottle or if necessary, flexed slightly outwardly a sufficient distance to be placed around neck 2 afterwhich it will move back to its unstressed position around the neck of the bottle. This enables the strap to be easily placed by one hand on the bottle, followed by the short movement of distal end 19 into housing 5 through inlet port 21. This is in contrast to the heretofore plastic molded housings and strap combinations wherein the strap, even though molded with the housing, extends outwardly in a flat condition requiring two-handed manipulation for placement around an object being protected.

The term "integral" with respect to strap 17 and housing 5 means that it is a one-piece member, which is easily molded enabling device 1 to be mass produced as a low cost item, easily purchased by a retail establishment in considerable numbers for placement on devices, and in particular, bottles to be protected thereby.

Figure 3:
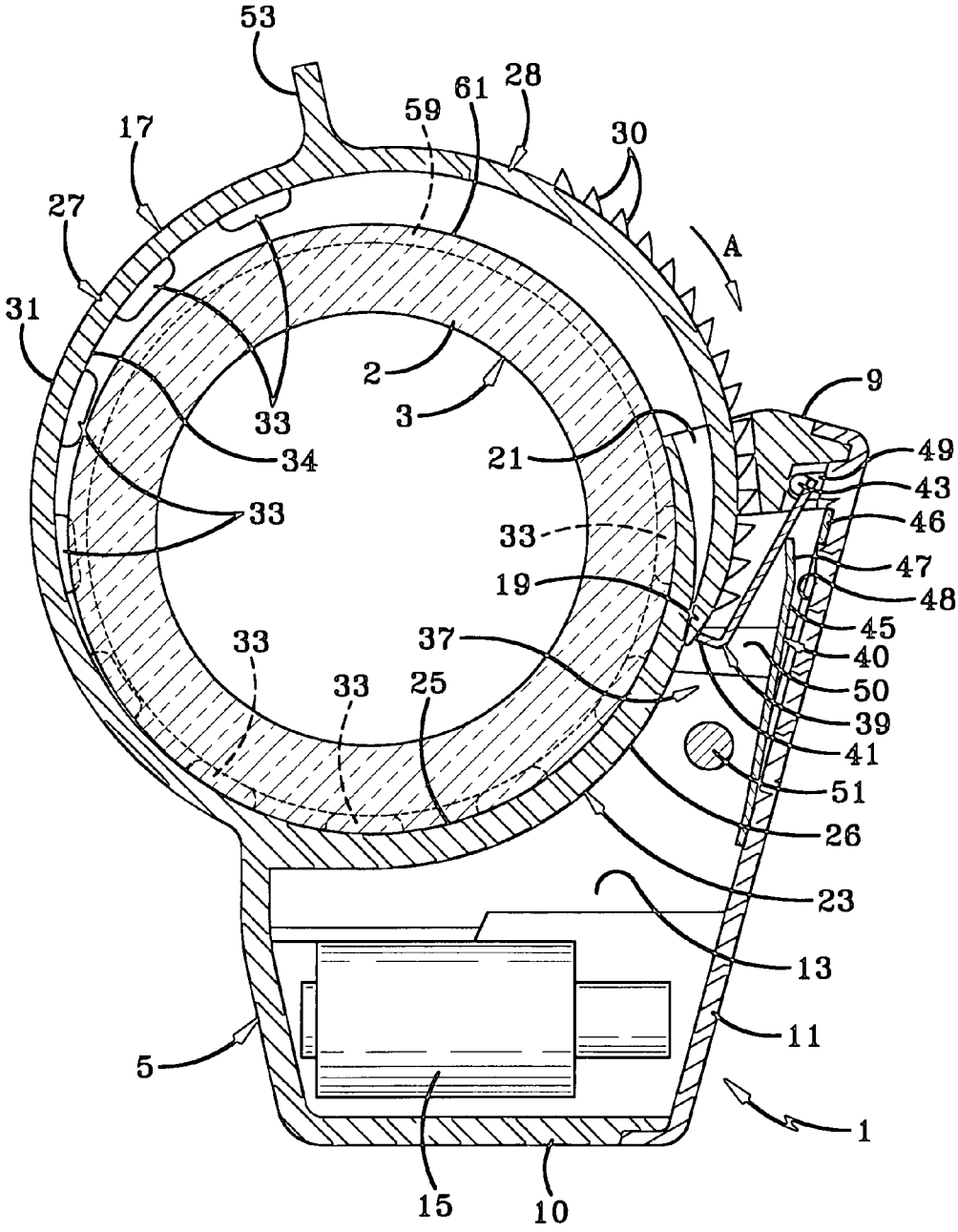
FIG. 3 is an enlarged sectional view showing the security device being moved to a locked position around the neck of a bottle.
Figure 4:
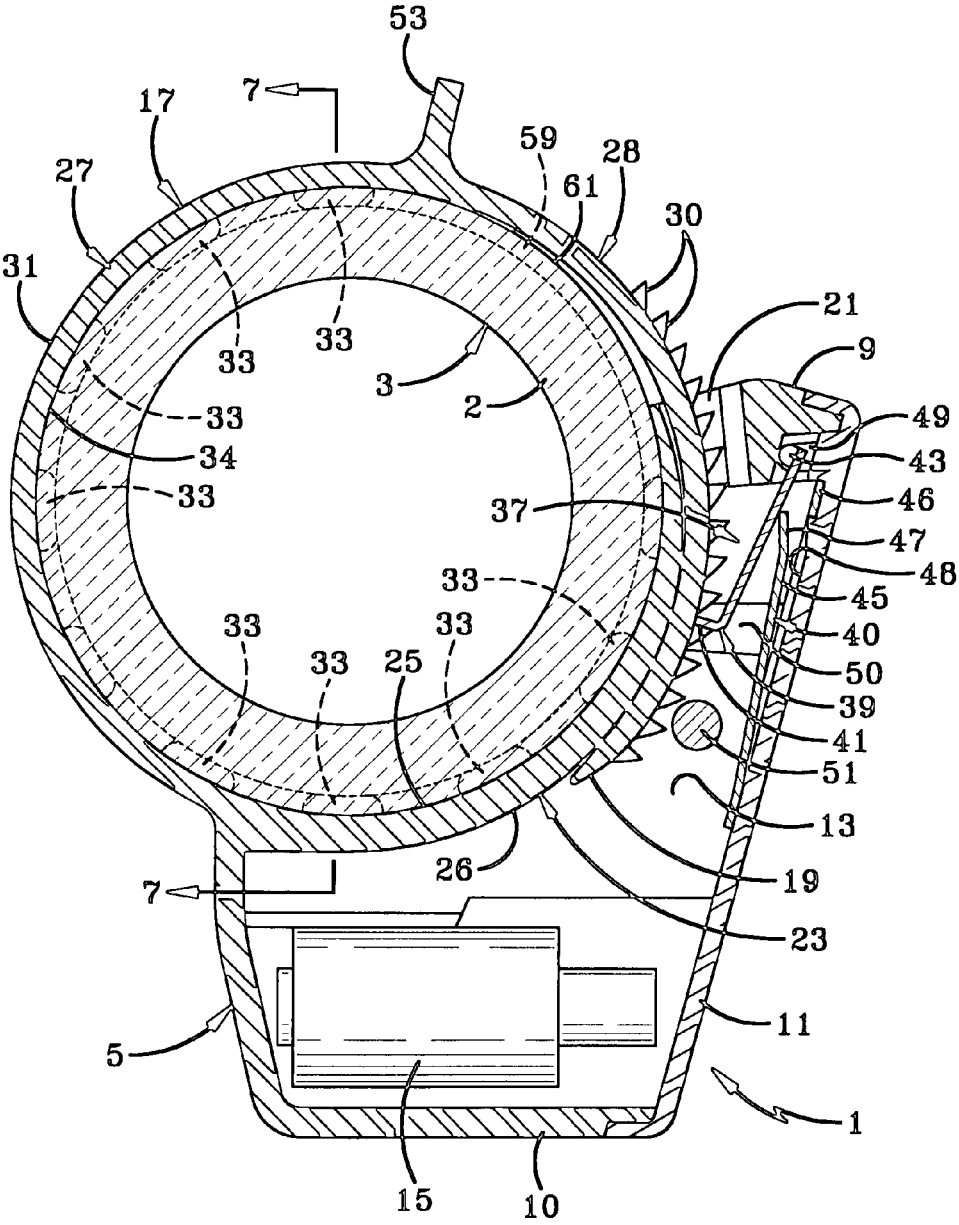
FIG. 4 is a view similar to FIG. 3 showing the security device in a locked position around the neck of the bottle.

Furthermore as shown in FIG. 2, housing 5 includes a curved arcuate flange 23, which is formed integrally with side walls 7 of the housing and extends beyond the sides thereof to provide a curved contact engaging surface 25, which is placed against the bottle neck when device 1 is secured thereto as shown in FIG. 1. It is surface 25, together with preset curved strap 17 that forms the generally circular configuration thereto for receiving neck 2 of bottle 3 therein. Arcuate flange 23 also provides an inner curved surface 26 (FIGS. 3 and 4) which provides a guide surface along which distal end 19 of ratchet strap 17 will move as the strap moves into the housing and into a closed locking position as shown in FIGS. 3 and 4. Again the present curvature of strap 17 assists in guiding distal end 19 of strap 17 along surface 26 so that locking teeth 30 formed on strap 17 is properly positioned adjacent a locking mechanism.

Ratchet strap 17 has a first section 27 and a second section 28 with a series of one-way ratchet teeth 30 being formed on the outer surface of strap section 28. First strap section 27 preferably has a smooth outer surface 31 and has a plurality of spaced projections 33 formed along an inner surface 34 thereof. Projections 33 also extend into and along curved contact surface 25 of arcuate flange 23. The purpose of these projections are discussed further below.

Figure 6:
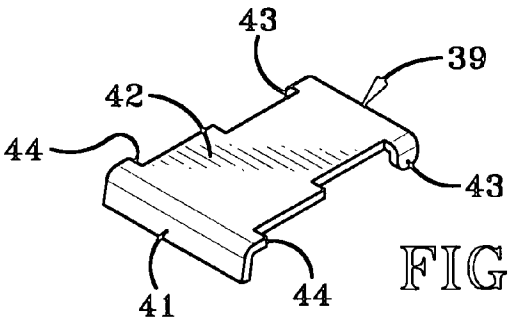
FIG. 6 is an enlarged perspective view of the locking pawl component of the locking mechanism.
Figure 5:
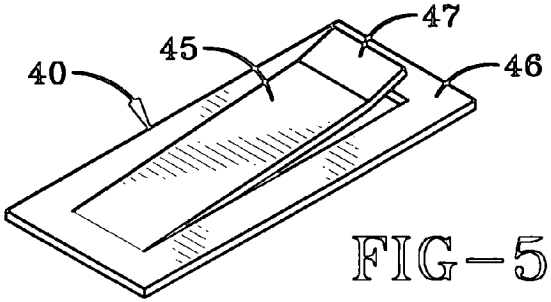
FIG. 5 is an enlarged perspective view of the spring biased actuating strip component of the locking mechanism of the security device.

As shown particularly in FIGS. 4-6, a locking mechanism indicated generally at 37, is formed within lock chamber 13 and consists of a locking pawl 39 and a spring biased actuation strip 40 (FIG. 5). Locking pawl 39 is formed out of metal and includes a bent lock end 41, which extends at a generally right angle to a main pawl body 42. Body 42 connects with end 41 by a pair of shoulders 44 and terminates at the opposite end in a pair of bent end flanges 43. Actuation strip 40 includes a flat strip of metal 46 and has a spring finger 45 extending outwardly therefrom and terminating in a bent end 47. Strip 46 is located within a shallow depression 48 formed in closure wall 11 and may be attached thereto by an adhesive or the like, whereby spring finger 45 projects outwardly therefrom as shown in FIGS. 3 and 4. Pawl 39 is loosely pivotably mounted in a pair of notches 49 formed in front wall 9 of housing 5 by bent end flanges 43 (FIG. 8) with shoulder 44 being located in spaced notches 50 formed in side walls 7. Thus as shown in FIGS. 3 and 4, spring finger 45 engages and biases locking pawl 39 toward the locked position as shown in FIG. 4 and maintains sufficient spring tension thereon to secure bent end 41 engaged with one of the one-way locking teeth 30 to prevent the strap from being removed from within locking compartment 30 until locking mechanism 37 is moved to the unlocked position as described below.

A guide pin 51 preferably extends through lock chamber 13 between side walls 7 and functions as a guide to assist in guiding distal end 19 of ratchet strap 17 along inner surface 27 as the strap is inserted through inlet port 21 in the direction of Arrow A (FIG. 3) toward a locking position as shown in FIG. 4. Pin 51 preferably is located adjacent to bent end 41 of locking pawl 39 to assist end 41 to maintain a locking engagement with a selected one of the locking teeth 30. Pin 51 merely serves as an assist guide since the preset curvature of ratchet strap 17 will usually be sufficient to guide distal end 19 toward sliding engagement along surface 27 as shown in FIG. 3.

A finger tab 53 is formed on ratchet strap 17 rearward of first strap section 27 and provides a convenient position for an individual to grasp or shove against to move latching strap 17 in the locking direction of Arrow A (FIG. 3) for securing it around a bottle neck.

In accordance with another feature of the invention, a plurality of pain bumps 55 are formed integrally on an project outwardly from side walls 7. These "pain bumps" are defined as generally thin projections having a somewhat rounded top point 56 and will cause some pain and discomfort to an individual should he/she grasp security device 1 between the thumb and a finger and attempt to twist device 1 or forcibly remove it from the bottle neck. Casual contact with the generally rounded tops 56 will not cause pain or harm to an individual unless a hard downward force is exerted thereon, which would occur if an attempt is made to grasp and twist the security device from the bottle. Thus, these pain bumps have no effect on the operation of security device 1 and do not pose a threat to personnel handling the security devices and/or bottle containing the same unless an excessive unlawful downward force is exerted on housing 5 as would occur by grasping it between a finger and thumb and attempting to twist device 1 from the bottle.

Figure 7:
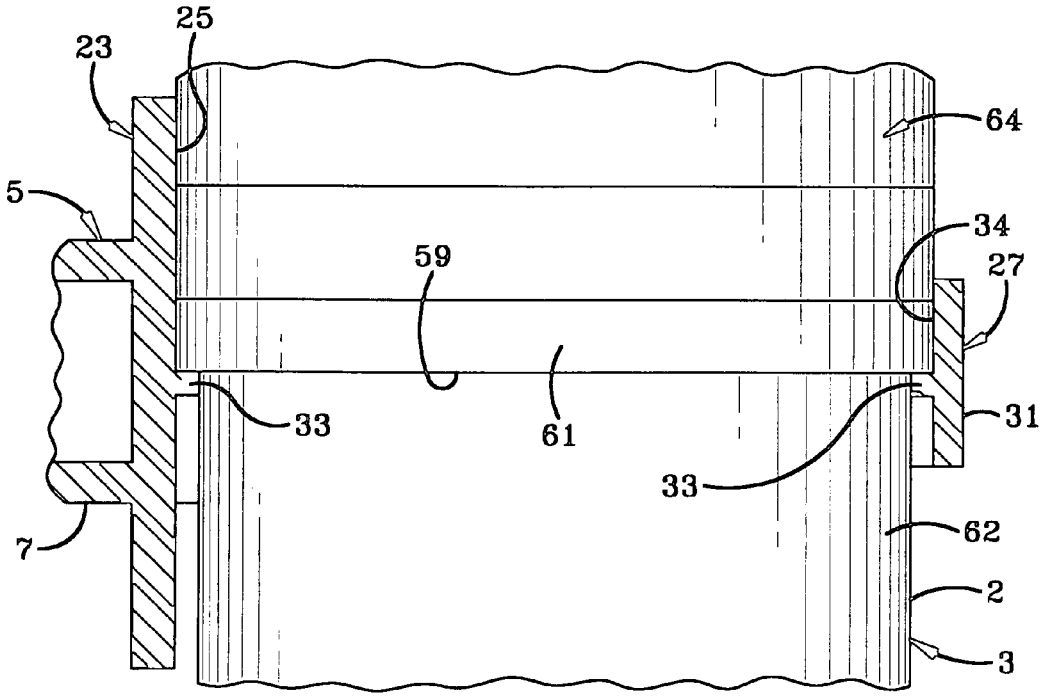
FIG. 7 is an enlarged fragmentary view of the neck of a bottle with a portion of the locking device shown in section secured in locked position thereabout.

As shown in FIG. 7, many bottles will have a stepped shoulder 59 formed by a larger upper diameter neck portion 61 and a smaller diameter neck portion 62, above which is a closure cap 64. Projections 33 formed on the inner surface of strap 17 and on arcuate contact surface 34 extend beneath step shoulder 59 when in a closed locked position on the bottle and assist in retaining security device 1 on the bottle. Another feature of the invention is that enlarged curved arcuate flange 23 will extend along the neck of a bottle such as shown in FIG. 7, and provide a large surface to prevent an individual from twisting the security device on the bottle neck in an attempt to dislodge the same. Any twisting force is exerted over this larger contact surface 25 making it extremely difficult to wobble or twist security device 1 once installed on the bottle neck.

The term "locked" as used throughout means that the security device is secured against opening without the use of a special key. This is in contrast with devices that are "latched" which can be opened without the use of a special key.

Figure 8:
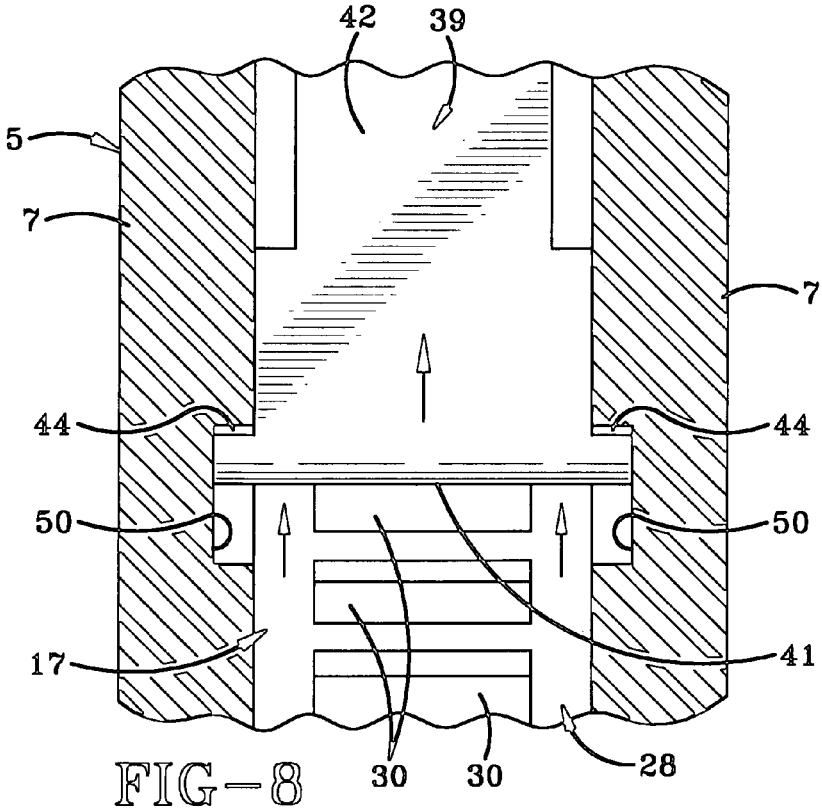
FIG. 8 is an enlarged fragmentary view showing the pivotal mounting of the locking pawl in the lock housing shown in section.

The operation of security device 1 is shown particularly in FIGS. 3 and 4. As stated previously, the preset curvature of strap 17 enables an individual with a single hand to place the strap around a bottle neck and with one finger insert distal end 19 of strap 17 through inlet port 21 by pushing on finger tab 53. Distal end 19 will move past spring biased locking pawl 39 which will move toward and slightly compress actuation strip 40 until it is sufficiently tight around the bottle neck, in which position spring strip 40 will move locking pawl 39 into locking engagement with one of the locking teeth 30 as shown in FIG. 4. Due to the generally right-angled configuration of the rear surfaces of the one-way teeth which engage bent end 41, strap 17 cannot move in the unlocking direction so long as locking pawl 39 is maintained in engagement with a select tooth by actuation strip 40. Also, the engagement of shoulders 44 of locking pawl 39 within notches 50, as shown in FIG. 8, will prevent bent end 41 from moving into engagement with surface 26 to block or retard the passage of distal end 19 of strap 17 therebetween.

Figure 9:
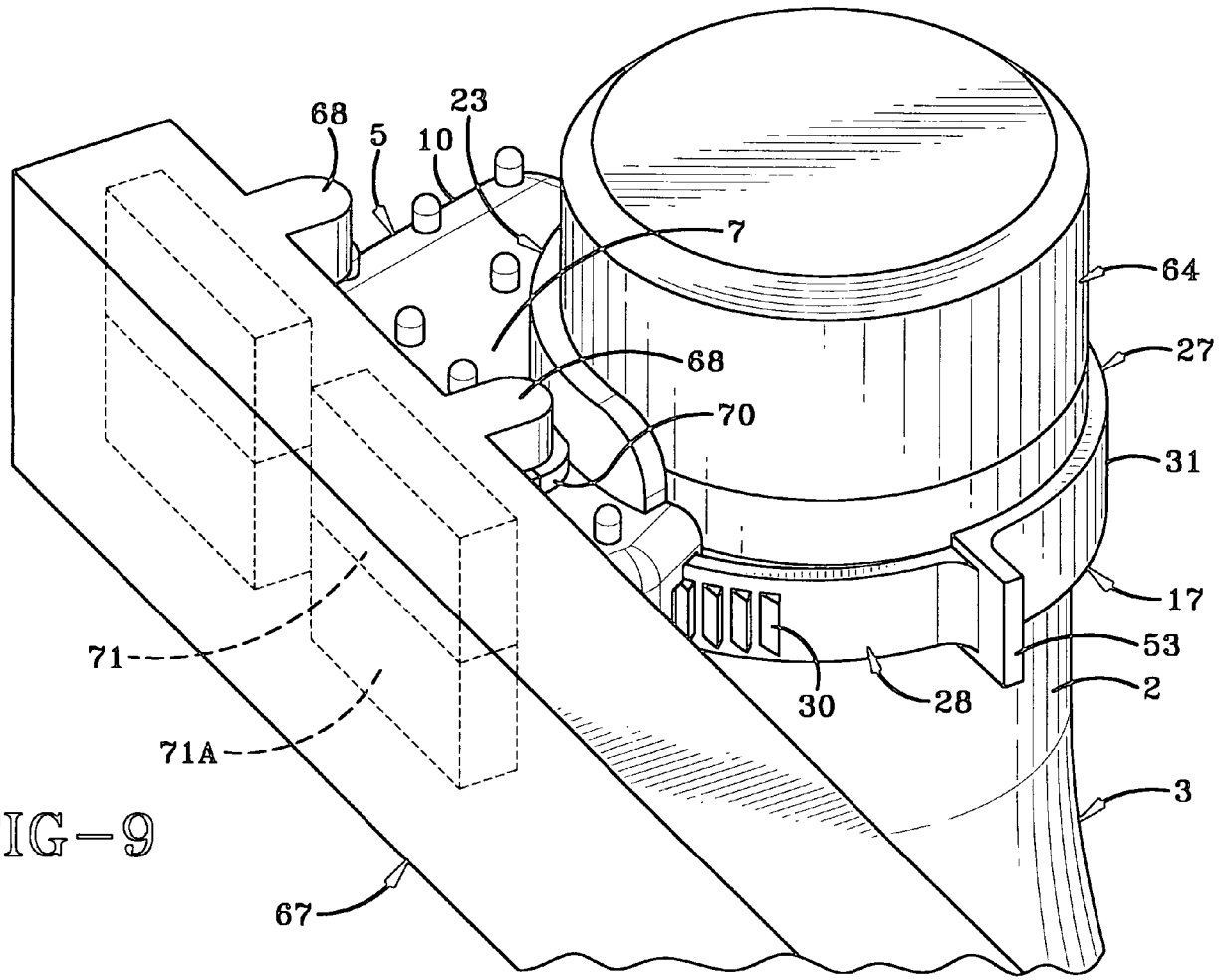
FIG. 9 is a fragmentary perspective view showing a magnetic key placed in position on the security device for unlocking the locking mechanism.
Figure 10:
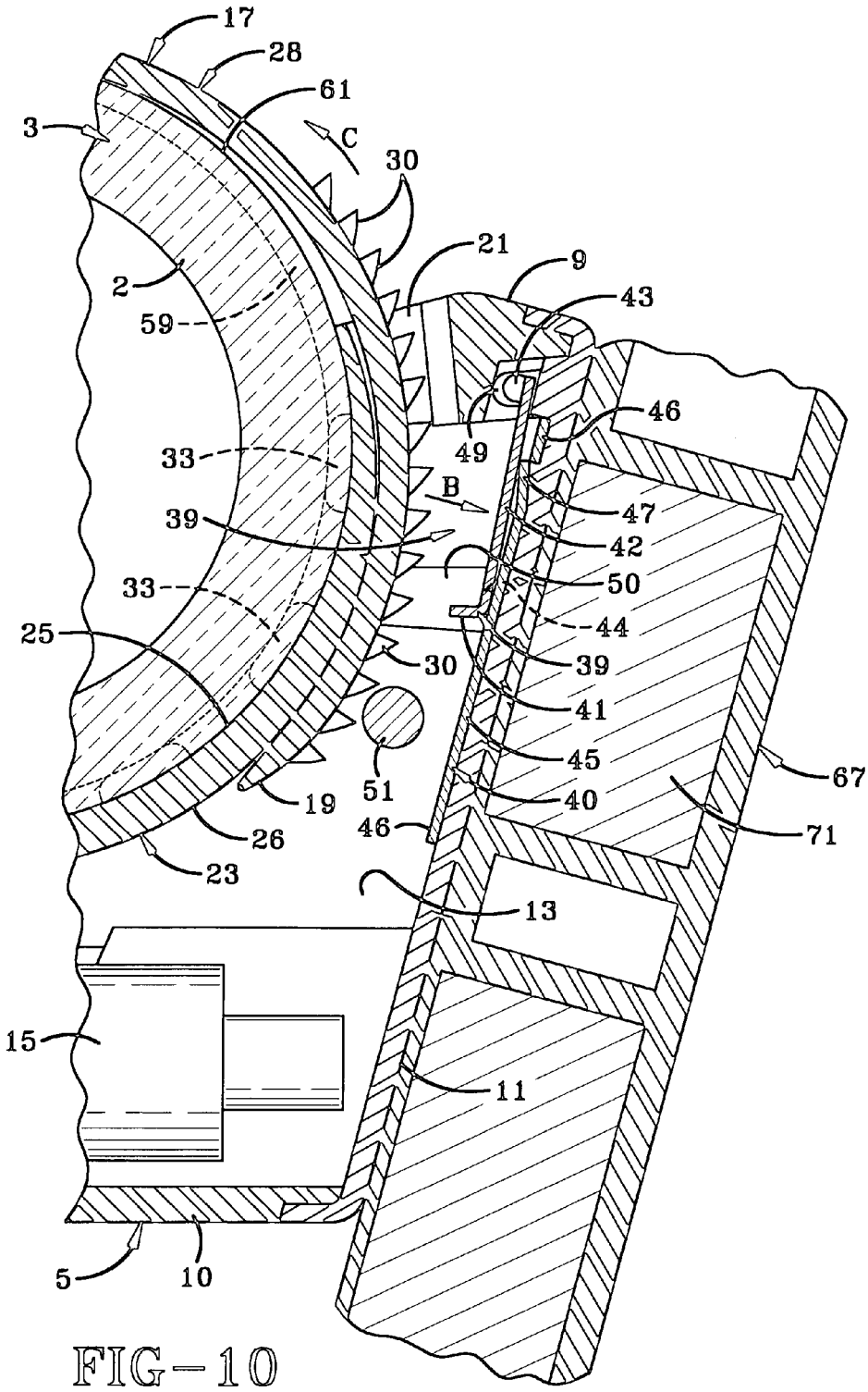
FIG. 10 is an enlarged fragmentary sectional view showing the magnetic key moving the locking mechanism to an unlocked position.
Figure 11:
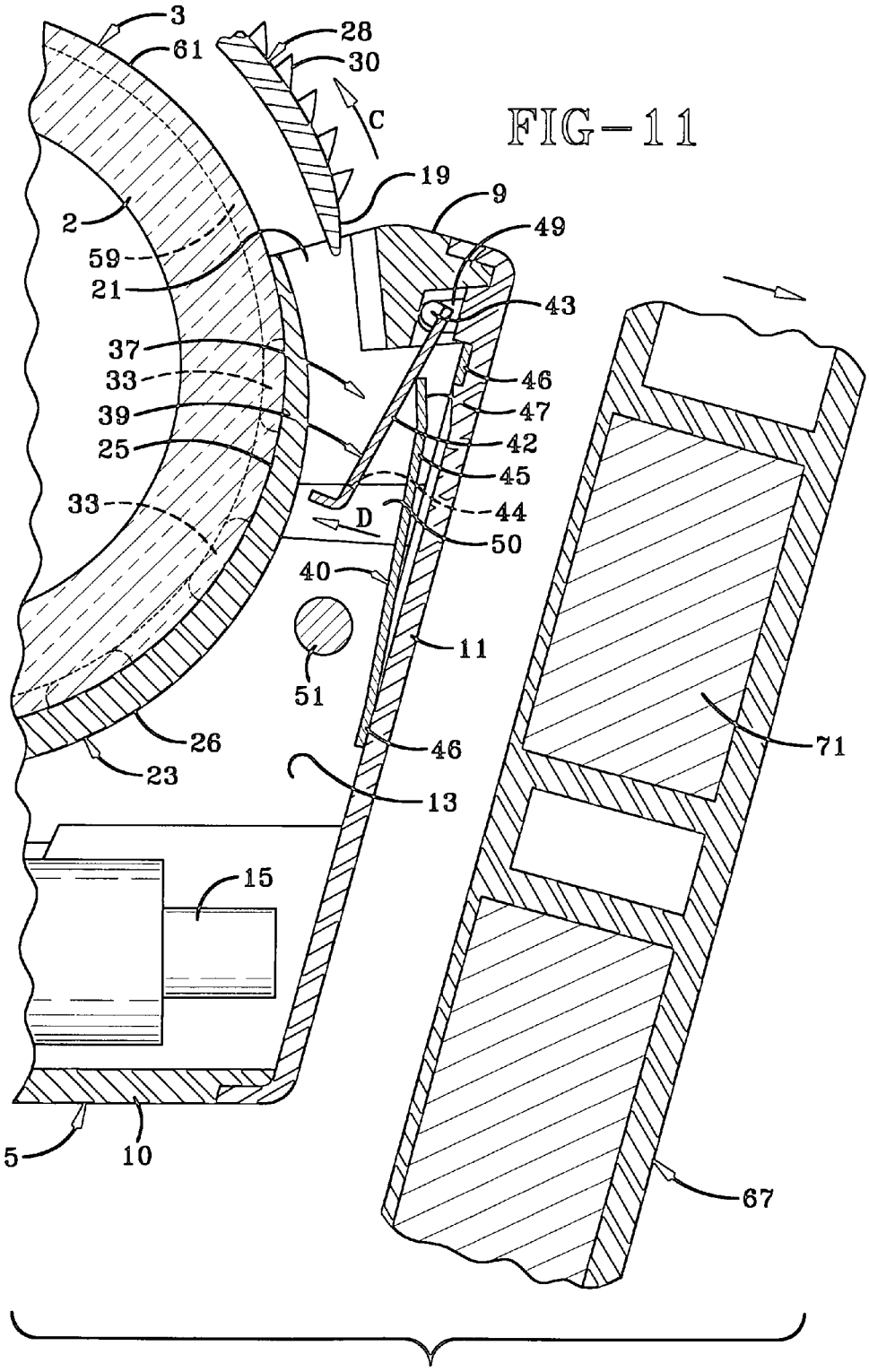
FIG. 11 is an exploded fragmentary view similar to FIG. 10, with portions in section showing the magnetic key removed from the security device and the actuating strip biasing the locking pawl toward the locked position.

To unlock security device 1 and enable strap 17 to be loosened from around bottle neck 2, a magnetic key 67 (FIGS. 9-11) is placed in a specific position against closure wall 11 by placement of one of a pair of alignment tabs 68 within an arcuate-shaped concave alignment notch 70 formed on one, and preferably on both side walls 7. Placement of tab 68 in notch 70 ensures that a magnet 71, or preferably a pair of specially designed magnets 71 and 71A, are aligned with actuation strip 40 and pawl 39 as shown in FIG. 10. This ensures that a sufficient magnetic field is generated which will attract both locking components 39 and 40 in the direction of Arrow B (FIG. 10) which will enable strap 17 to be moved in the unlocking direction of Arrow C. Due to the need to attract both locking pawl 39 and actuation strip 40, it requires a strong magnet accurately placed to create a strong magnetic field necessary to retract both components. This is in contrast to other types of magnetic unlocking devices which use only a single locking finger that must be retracted by a magnet. Thus, someone attempting to defeat locking mechanism 37 by a single magnet may not create a sufficiently strong magnetic field to retract both locking components, even if accurately placed against closure wall 11 of housing 5. After removal of magnetic key 67 (FIG. 11) from housing 5, actuation strip 40 will bias locking pawl 39 in the direction of Arrow D where it is in position for locking engagement with strap 17 as shown in FIG. 4, when distal end 19 is inserted through inlet port 21.

Thus security device 1 provides a relatively simple and inexpensive device which conceals and contains various types of EAS tags or other electronic security devices within a housing. Device 1 can be mass produced relatively inexpensively by plastic molding, which when molded, will include the ratchet strap 17 integral therewith, and which requires only the insertion of the two metallic locking components 39 and 40 and guide pin 51 into the lock compartment. Closure wall 11 then is secured in position by an adhesive, sonic welding or the like. Once closure wall 11 is permanently attached to enclose lock chamber 13, the lock mechanism and EAS tag are secured therein from external intrusion and are self-actuating, that is, locking pawl 39 returns automatically to the locking position for engagement with the strap end when reinserted into the lock housing upon removal of magnetic key 67.

Furthermore, the preset curvature of strap 17 greatly facilitates its placement on a bottle neck or about another type of cylindrical object such as a racket handle etc. since distal end 19 is already aligned with inlet port 21 and requires easy single-handed manipulation to secure the strap about the object. Likewise, arcuate flange 23, together with pain bumps 55, reduces the possibility that excessive force can be applied to security device by a twisting motion to dislodge it from a bottle neck.

It is understood that the pair of magnetic attractable locking components could be replaced with other types of magnetic operated devices. However, the use of the pair of components increases the reliability of the security system in thwarting the unauthorized use of a magnet by a possible shoplifter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security device for attaching to an article to be protected from theft, said device comprising:

a rigid housing;

a compartment formed in the housing;

an entry port in communication with the compartment;

a strap permanently connected to and extending outwardly from the housing to a terminal end and having sufficient stiffness to provide a preset curvature to the strap;

an unsecured position of the strap in which the terminal end of the strap is located closely adjacent the entry port to facilitate insertion of the terminal end through the entry port; and a secured position of the strap in which the strap and housing together form a closed loop around an article-receiving space when the terminal end is inserted through the entry port into the compartment; the article-receiving space adapted to receive a portion of the article.

2. The device of claim 1 further comprising a convexly curved inner surface on the housing which bounds the compartment; and a concavely curved inner surface on the strap having a mating configuration with the convexly curved inner surface on the housing for forming a mating engagement therewith in the secured position.

3. The device of claim 2 further comprising a guide pin mounted in the compartment for engaging the strap during its insertion into the compartment to guide the strap to form the mating engagement.

4. The device of claim 1 further comprising a convexly curved inner surface on the housing which bounds the compartment; and a concavely curved article contact surface which parallels the convexly curved inner surface and bounds the article-receiving space.

5. The device of claim 4 further comprising a concavely curved inner surface on the strap having a mating configuration with the convexly curved inner surface on the housing for forming a mating engagement therewith in the secured position.

6. The device of claim 1 further comprising an article contact surface on the housing bounding the article-receiving space and adapted to contact the article; wherein the article contact surface and the strap together assume a substantially circular configuration in the unsecured position.

7. The device of claim 6 wherein the article contact surface is a concavely curved surface.

8. The device of claim 1 wherein the strap is formed together with the housing as an integral one-piece member.

9. The device of claim 1 further comprising an arcuate wall on the housing; and a concavely curved article contact surface on the arcuate wall bounding the article-receiving space and adapted to contact the article.

10. The device of claim 9 wherein the strap is formed together with the arcuate wall as an integral one-piece member.

11. The device of claim 10 further comprising spaced sidewalls on the housing; and wherein the concavely curved article contact surface has a width greater than the spaced sidewalls.

12. The device of claim 1 further comprising a push tab connected to and extending outwardly from the strap and manually pushable for inserting the terminal end of the strap into the compartment through the entry port.

13. The device of claim 1 further comprising a guide pin mounted in the compartment for engaging the strap during insertion thereof into the compartment to guide movement of the strap within the compartment.

14. The device of claim 13 further comprising a series of one-way locking teeth on the strap; and a securing mechanism which engages at least one of the teeth to secure the strap in the secured position; and wherein the guide pin facilitates positioning of the locking teeth for engagement with the securing mechanism.

15. The device of claim 14 wherein the guide pin engages the locking teeth during insertion of the strap.

16. The device of claim 1 wherein the terminal end of the strap is disposed within the compartment in the secured position.

17. The device of claim 16 wherein the housing is free of an exit opening through which the terminal end may exit the housing.

18. The device of claim 16 wherein the terminal end of the strap can be removed from the housing only through the entry port.

19. The device of claim 1 further comprising a securing mechanism for securing the strap in the secured position.

20. The device of claim 1 further comprising a plurality of spaced first projections connected to and extending from one of the housing and strap into the article-receiving space and adapted to engage an annular shoulder of a bottle neck to assist in retaining the security device on the bottle neck.

* * * * *